US012324515B2

(12) United States Patent
Chen

(10) Patent No.: US 12,324,515 B2
(45) Date of Patent: Jun. 10, 2025

(54) MIDDLE AND INNER RAILS SYNCHRONIZATION MECHANISM OF SLIDE RAIL

(71) Applicant: MARTAS PRECISION SLIDE CO., LTD., New Taipei (TW)

(72) Inventor: Wan-Lai Chen, New Taipei (TW)

(73) Assignee: MARTAS PRECISION SLIDE CO., LTD., New Taipei (TW)

( * ) Notice: Subject to any disclaimer, the term of this patent is extended or adjusted under 35 U.S.C. 154(b) by 176 days.

(21) Appl. No.: 18/132,980

(22) Filed: Apr. 11, 2023

(65) Prior Publication Data

US 2024/0341470 A1 Oct. 17, 2024

(51) Int. Cl.
*A47B 88/49* (2017.01)
*A47B 88/423* (2017.01)

(52) U.S. Cl.
CPC ..... *A47B 88/49* (2017.01); *A47B 88/423* (2017.01)

(58) Field of Classification Search
CPC ..... A47B 88/49; A47B 88/423
See application file for complete search history.

(56) References Cited

U.S. PATENT DOCUMENTS 5,255,983 A * 10/1993 Parvin ..... A47B 88/57 312/333
6,729,703 B2 * 5/2004 Le ..... A47B 88/57 312/334.46
6,805,418 B2 * 10/2004 Milligan ..... A47B 88/49 312/334.47
7,111,913 B2 * 9/2006 Dubon ..... A47B 88/49 312/333
7,210,752 B2 * 5/2007 Dubon ..... A47B 88/49 312/333
7,744,174 B2 * 6/2010 Peng ..... A47B 88/477 312/334.47
9,538,845 B1 * 1/2017 Chen ..... A47B 88/49
9,848,701 B1 * 12/2017 Chen ..... A47B 88/57
10,463,149 B1 * 11/2019 Chen ..... A47B 88/473
10,477,965 B1 * 11/2019 Chen ..... A47B 88/43
10,610,015 B2 * 4/2020 Chen ..... F16C 29/10
10,743,660 B2 * 8/2020 Chen ..... H05K 7/1489
10,806,255 B1 * 10/2020 Chen ..... A47B 88/443
11,149,789 B2 * 10/2021 Tang ..... F16C 29/008
11,246,410 B2 * 2/2022 Chen ..... A47B 88/443
11,445,824 B2 * 9/2022 Chen ..... A47B 88/49
(Continued)

*Primary Examiner* — Daniel J Troy
*Assistant Examiner* — Timothy M Ayres
(74) *Attorney, Agent, or Firm* — Fei-hung Yang

(57) ABSTRACT

A middle and inner rails synchronization mechanism includes an installation part, an elastic control plate and a synchronization hook. The installation part is arranged at rear position of a middle rail and has a pivoting part arranged at an end and an elastic part arranged in middle of the installation part, such that the elastic control plate is disposed a surface of the middle rail relative to the inner rail for swinging, a retaining wall is formed and bent from a side edge of the elastic control plate relative to the pivoting part, a guide surface and a stop surface are integrally formed on the retaining wall and in direction when the inner rail passing through, the synchronization hook is installed on the inner rail relative to a surface of the middle rail and snapped and engaged with the elastic control plate to define a synchronization state.

7 Claims, 6 Drawing Sheets

(56) References Cited

U.S. PATENT DOCUMENTS

| | | | | |
|---|---|---|---|---|
| 11,641,939 | B2 * | 5/2023 | Chen | A47B 88/49<br>312/334.44 |
| 11,641,940 | B2 * | 5/2023 | Chen | A47B 88/493<br>312/334.44 |
| 11,778,770 | B1 * | 10/2023 | Chen | A47B 88/447<br>312/333 |
| 2024/0115043 | A1 * | 4/2024 | Chen | A47B 88/44 |
| 2024/0122342 | A1 * | 4/2024 | Chen | A47B 88/423 |

* cited by examiner

MIDDLE AND INNER RAILS SYNCHRONIZATION MECHANISM OF SLIDE RAIL

BACKGROUND

Technical Field

The present disclosure relates to the field of a furniture slide rail, and more particularly relates to a middle and inner rails synchronization mechanism to be installed inside the slide rail, such that when an improper external force hits on a drawer, an inner rail hook forcibly props open an elastic control plate to provide a release, so as to protect an elastic plate part from breaking and prevent the drawer from getting stuck and unable to be opened.

Description of Related Art

Desks, cabinets and other furniture are usually equipped with drawers for the convenience of storage. In addition to the anti-theft function, the drawers can also improve the tidiness of the furniture after storage. Compared to the furniture itself, drawers frequently involve a pulling reciprocal movement. In recent years, furniture requires good aesthetic appearance and texture and improves the smoothness of the drawers or door panels for operation, and a pair of slide rails is usually installed between a cabinet and the drawer to make the pulling or pushing of the drawer smoother. The slide rails of this sort used to assist sliding the drawers can be divided into two-stage slide rails and three-stage slide rails according to their expanding length, and the three-stage slide rails are most commonly used for the convenience of use. The three-stage slide rail mainly includes an outer rail, a middle rail, an inner rail and two sliding parts, the outer rail is usually fixed inside the cabinet, the inner rail is fixed to two opposite sides of the drawer, and the middle rail is connected between the outer rail and the middle rail and between the middle rail and the inner rail through by two sliding parts such as a ball bearing and a roller, etc., such that the inner rail and the middle rail can slide in and out smoothly along the same axial direction relative to the outer rail, and such design also can save space after storage.

However, the major shortcoming of the three-stage slide rail is that the inner rail, the middle rail and the outer rail cannot move according to a predetermined sequence during operation, thereby giving rise to the problem of unsmooth sliding. Therefore, most three-stage slide rails have a structural design with a synchronization mechanism, which can position the middle rail within its stretching limit and release the locked state of the middle rail when the inner rail is retracted, so as to achieve the effect of synchronously retract the middle rail with the inner rail. However, the drawback of this structural design is that it just aims at the synchronization for the one-way pull-out operation only, but there is no synchronization effect for the push-in operation.

Moreover, there is no locking function, that is, if the drawer is hit by an improper external force after being pulled out, the drawer will be pushed during use, which may cause a potential danger of pinching the users, or damaging the synchronization mechanism that may reduce the smoothness of the drawer during use. Obviously, the conventional slide rail needs improvements.

In view of the aforementioned drawbacks of the related art, the inventor of this disclosure conducted extensive research and experiment and finally developed a middle and inner rails synchronization mechanism that uses an integrally formed structure of an elastic control plate and a synchronization hook and an inner rail releasing outer rail lock integrally formed on the inner rail and the outer rail, and this design not only can greatly simplify the structure to reduce the assembling and manufacturing costs, but also can forcibly prop open the elastic control plate to define a release state by its special mechanical design when an improper external force hits the drawer, and the inner rail hook is forced to prop open, so as to achieve the effects of protecting the elastic plate part from breaking, preventing the drawer from getting stuck and unable to be opened, and achieving the smooth push-in and pull-out movements during operations.

SUMMARY

To achieve the aforementioned and other objectives, this disclosure discloses a middle and inner rails synchronization mechanism including an installation part, an elastic control plate and a synchronization hook. The installation part, the elastic control plate and the synchronization hook are integrally formed, and the synchronization hook is installed on a surface of the inner rail relative to the middle rail and snapped and engaged with the elastic control plate to define a synchronization state. In addition, the elastic control plate has a guide surface and a stop surface arranged at a special angle, such that when an improper external force hits a drawer, the inner rail hook forcibly props open the elastic control plate to define a release state, so as to protect the elastic plate part from breaking and prevent the drawer from getting stuck and unable to be opened. This special mechanical design not only can greatly simplify the mechanical structure to reduce assembling and manufacturing costs, but also can improve the operating feel and effectively extend the service life.

To achieve the aforementioned and other objectives, this disclosure discloses a middle and inner rails synchronization mechanism of a slide rail, and the slide rail has a three-stage telescopic structural design which includes an inner rail, a middle rail and an outer rail. The middle and inner rails synchronization mechanism includes an installation part installed at a rear position of the middle rail, an elastic control plate having a pivoting part installed at an end of the elastic control plate, and an elastic part installed in the middle of the elastic control plate and provided to be installed to the installation part, such the elastic control plate is disposed on a surface of the middle rail relative to the inner rail for swinging, a retaining wall formed and bent from a side edge of the elastic control plate relative to the pivoting part, a guide surface and a stop surface integrally formed on the retaining wall in a direction when the inner rail passing through, a first set angle defined between the moving tracks of the stop surface and the middle rail, a second set angle defined between the guide surface and the middle rail, and a synchronization hook installed on a surface of the inner rail relative to the middle rail and bent and protruded from the surface, wherein the synchronization hook is normally snapped and engaged with the elastic control plate to define a synchronization state, and after the middle rail is moved to its limit and a specified force is applied, the synchronization hook props open the elastic control plate and the inner rail continues to be pulled towards the outside.

In an embodiment of this disclosure, the first set angle falls within a range of 113~115.5 degrees to achieve the effect of withstanding an external force of 25N~80N, and when the force exceeds the upper limit of this range, the synchronization hook forcibly props open the elastic control plate to define a release state. In addition, the second set angle falls within 11~25 degrees to improve the smoothness when pushing in the inner rail.

In another embodiment of this disclosure, the retaining wall is formed by bending a section of the elastic control plate with a length longer than the elastic control plate. After the section of the elastic control plate is bent to 90 degrees relative to a plane of the elastic control plate, it is further bent into the stop surface and the guide surface. In addition, a junction of the section of the elastic control plate and the elastic control plate, particularly a notch formed at a bend position of the stop surface and the guide surface by stamping and cutting can prevent producing wrinkles during the bending process and make the stop surface and the guide surface smooth, so as to improve the smoothness of moving the synchronization hook on the stop surface and the guide surface. In addition, the notch in the round shape can prevent producing centralized stress that may reduce service life.

In a further embodiment of this disclosure, the middle and inner rails synchronization mechanism further includes a limiting hole and a limiting plate, the limiting hole is formed on a side of the middle rail relative to the installation part, the limiting plate is formed on a side of the elastic control plate relative to the pivoting part, and during installation, the limiting plate passes through the limiting hole and reaches another surface of the middle rail. In addition, the middle and inner rails synchronization mechanism of this disclosure further includes an inner rail releasing outer rail locking hook is installed to the elastic control plate relative to another side of the retaining wall and bent in a direction opposite to the retaining wall, and the inner rail releasing outer rail locking hook is passed through another surface of the middle rail, and the outer rail includes an outer rail release part disposed at a position proximate to an outer side of the pulling direction. Therefore, after the inner rail releasing outer rail locking hook is triggered by the outer rail release part, the inner rail releasing outer rail locking hook is pushed to swing, so as to release the locked state of the middle rail and the inner rail, and sequentially pull the middle rail and the inner rail towards the outside.

DESCRIPTION OF THE EMBODIMENTS

This disclosure will now be described in more detail with reference to the accompanying drawings that show various embodiments of this disclosure.

Figure 1:
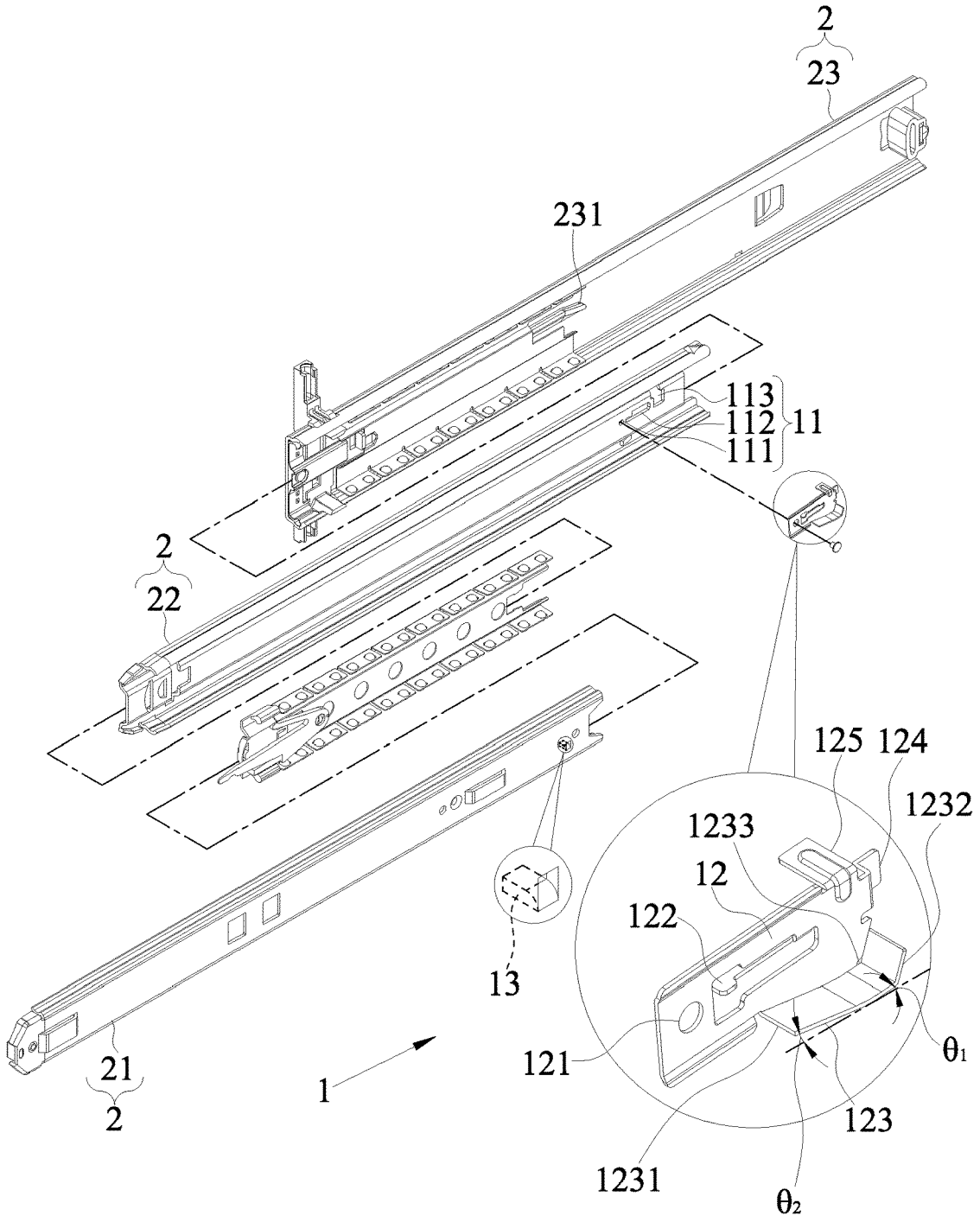
FIG. 1 is a first schematic view of the structure of a preferred embodiment of this disclosure.
Figure 2:
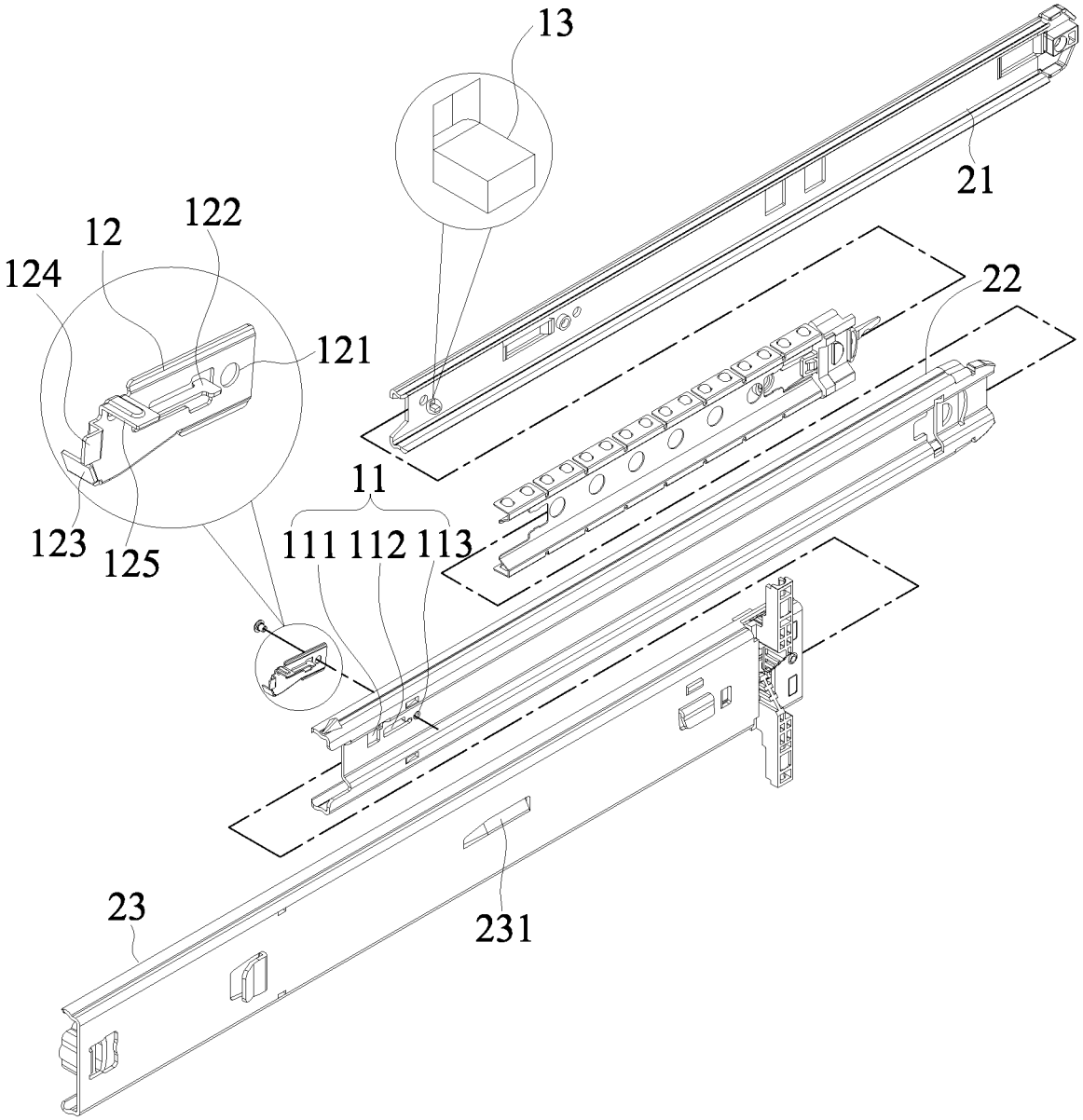
FIG. 2 is a second schematic view of the structure of a preferred embodiment of this disclosure.
Figure 3:
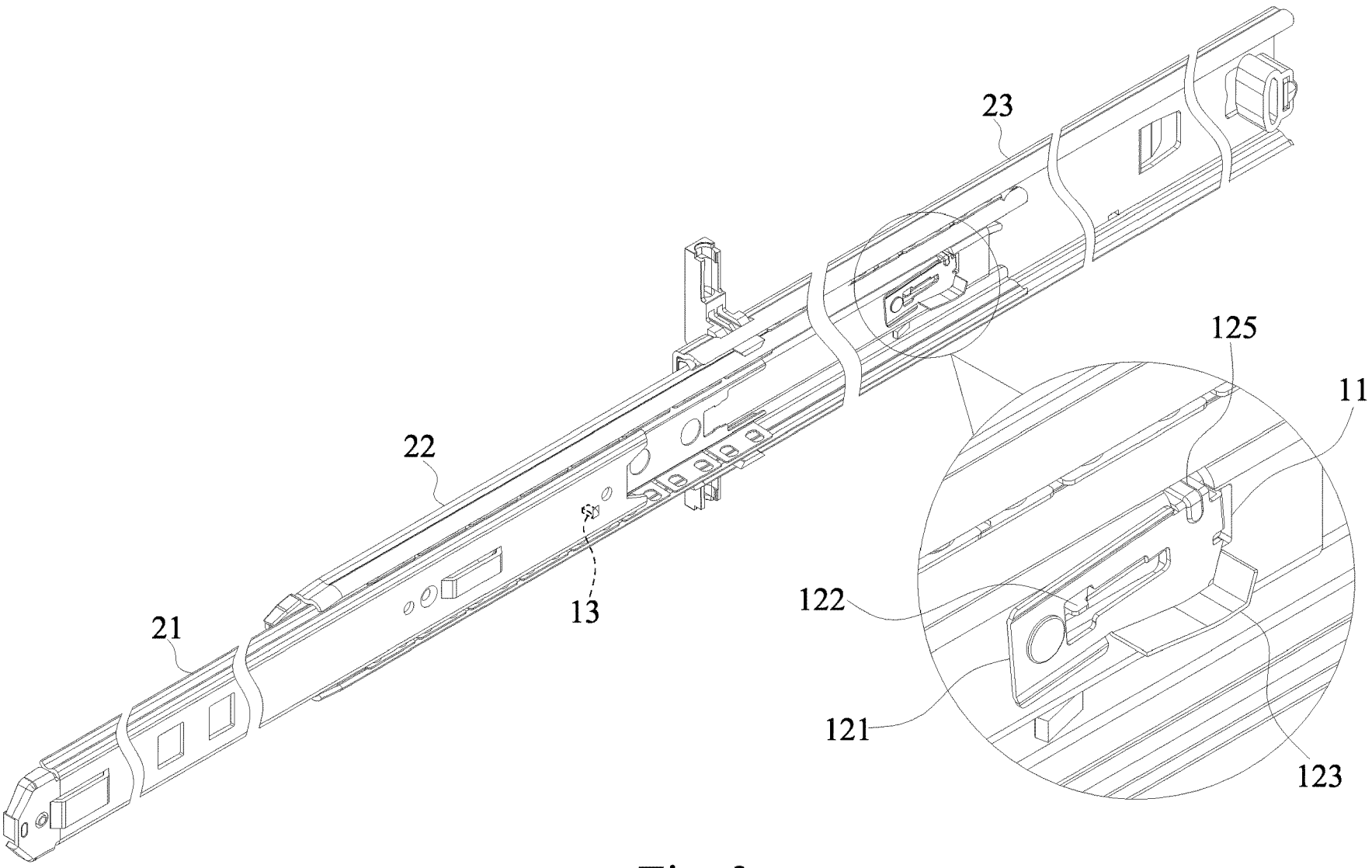
FIG. 3 is a schematic view showing the status of a preferred embodiment of this disclosure during installation.
Figure 4:
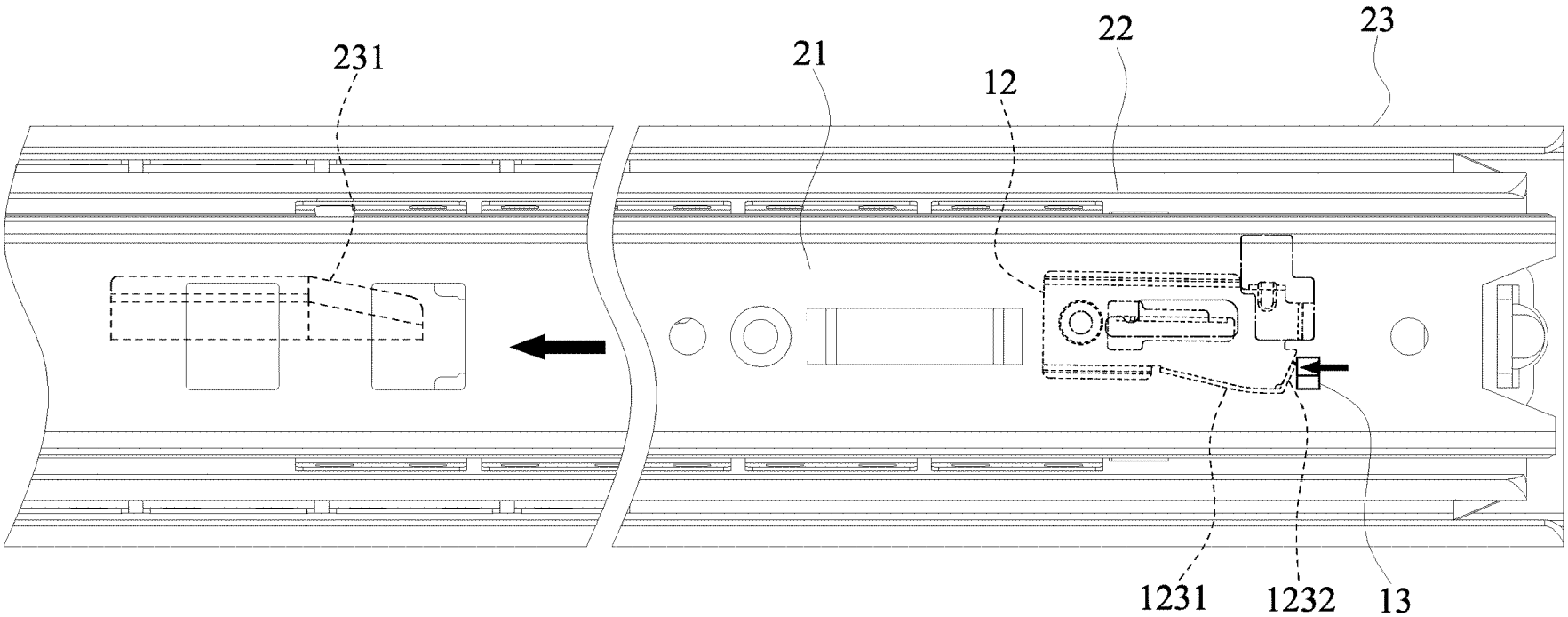
FIG. 4 is a first schematic view showing the status of a preferred embodiment of this disclosure during operation.
Figure 5:
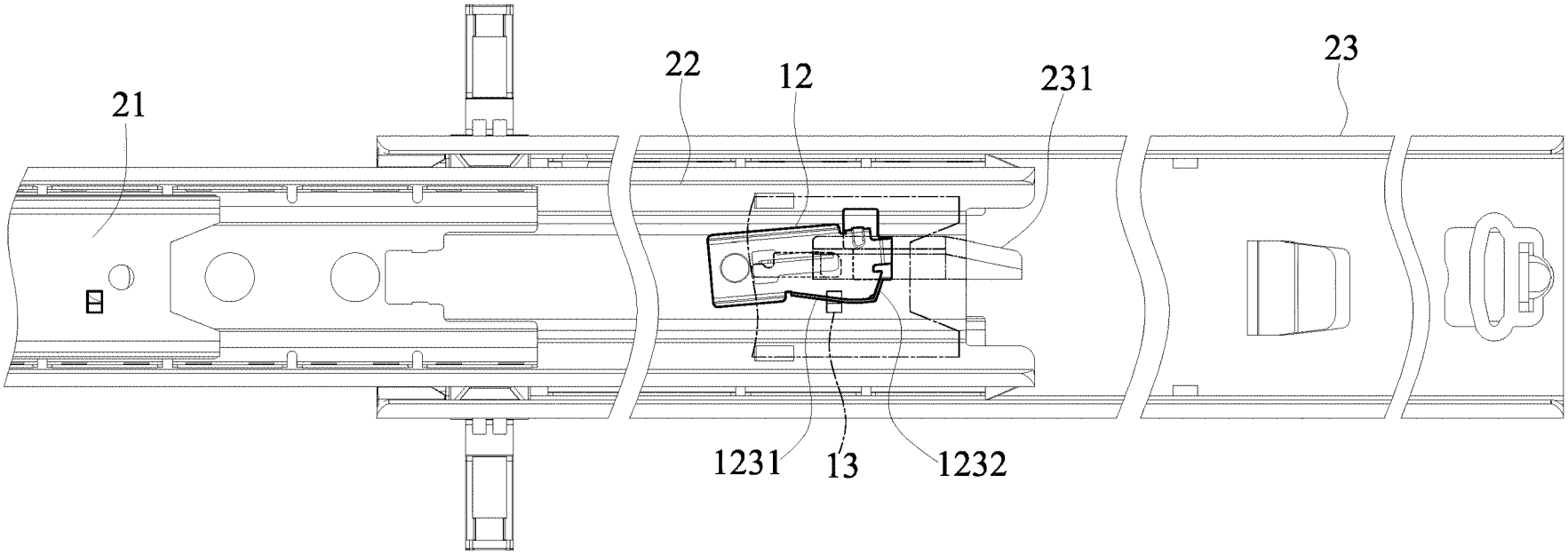
FIG. 5 is a second schematic view showing the status of a preferred embodiment of this disclosure during operation.
Figure 6:
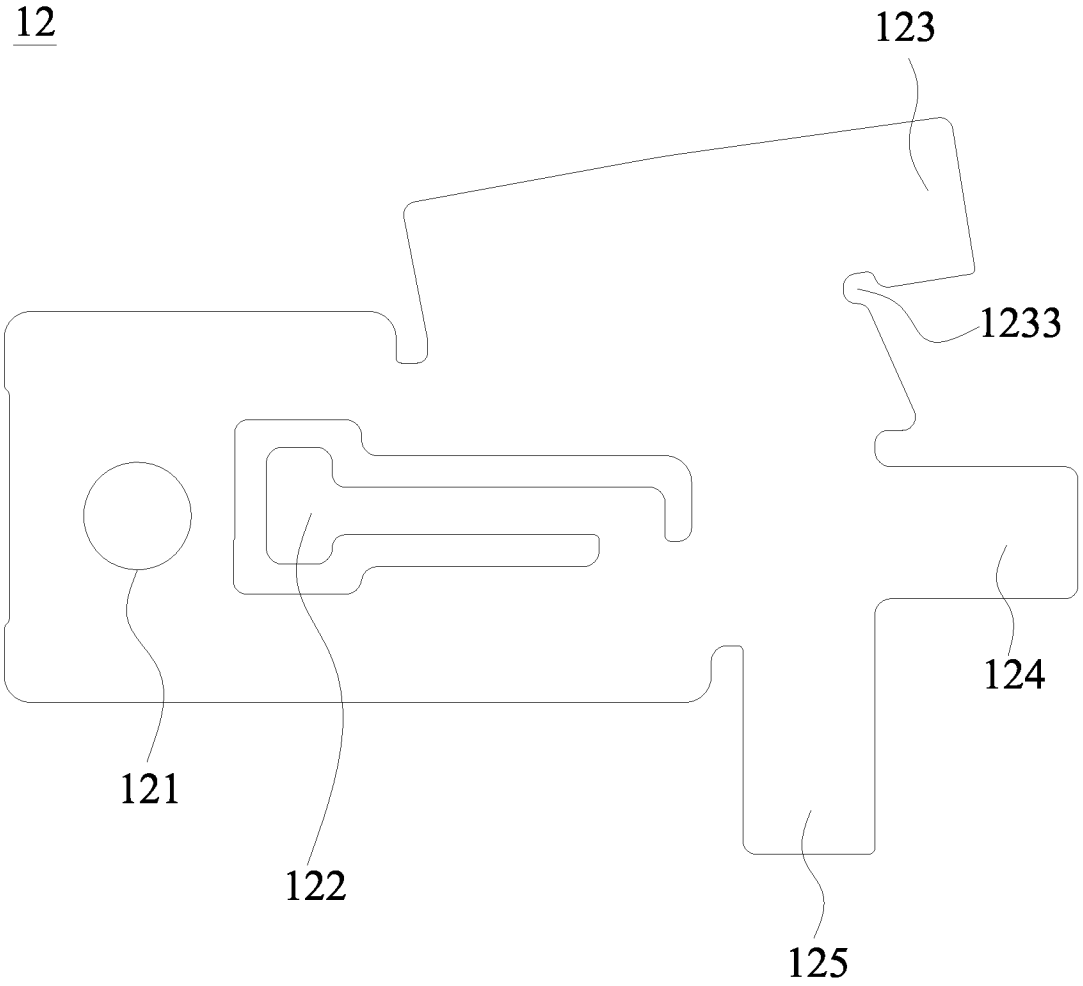
FIG. 6 is an expanded view of an elastic control plate in accordance with a preferred embodiment of this disclosure.

With reference to FIGS. 1, 2, 3 and 4~6 for the schematic views showing the structure viewing from different angles, the status after installation and various statuses during operation, and the expanded view of an elastic control plate in accordance with a preferred embodiment of this disclosure respectively, this disclosure provides a middle and inner rails synchronization mechanism 1 having a slide rail 2 with a three-stage telescopic structural design which includes an inner rail 21, a middle rail 22 and an outer rail 23, and the middle and inner rails synchronization mechanism 1 includes an installation part 11, an elastic control plate 12 and a synchronization hook 13.

The installation part 11 is integrally formed by stamping and installed to a rear position of the middle rail 22 includes a pivoting hole 111, a buckle part 112 and a limiting hole 113, and the pivoting hole 111 is formed on a side of the buckle part 112, and the limiting hole 113 is symmetrically formed on two opposite sides of the buckle part 112.

The elastic control plate 12 is integrally formed by bending, stamping and cutting a metal sheet, and an end of the elastic control plate 12 is provided with a pivoting part 121 and the middle of the elastic control plate 12 is provided with an elastic part 122 and to be installed to the installation part 11. The pivoting part 121 is movably pivoted to the pivoting hole 111, and the elastic part 122 abuts against the buckle part 112, such that the elastic control plate 12 is disposed on a surface of the middle rail 22 relative to the inner rail 21 and provided for swinging, and a retaining wall 123 is formed by bending a side edge of the elastic control plate 12 relative to the pivoting part 121. The retaining wall 123 has a guide surface 1231 and a stop surface 1232 integrally formed in a direction corresponding to the direction in which the inner rail 21 passing through, a first set angle θ1 is defined between the moving tracks of the stop surface 1232 and the middle rail 22, and a second set angle θ1 is defined the moving tracks between the guide surface 1231 and the middle rail 22. Wherein, the first set angle θ1 falls within a range of 113~115.5 degrees to achieve the effect of withstanding an external force of 25N~80N, and when the force exceeds the upper limit of this range, the synchronization hook 13 forcibly props open the elastic control plate 12 to define a release state, the second set angle θ2 falls within a range of 11~25 degrees, which can improve the smoothness of pushing in the inner rail 21. It is noteworthy that the retaining wall 123 is formed by a section of the elastic control plate 12, and the length of the retaining wall 123 is longer than the elastic control plate 12, the retaining wall is bent 90 degrees relative to a plane of the elastic control plate 12 first, and then bent to form the stop surface 1232 and the guide surface 1231.

In addition, a junction of the section of the elastic control plate 12 and the elastic control plate 12, particularly a notch 1233 at a bend position of the stop surface 1232 and the guide surface 1231 formed by stamping and cutting prevents the stop surface 1232 and the guide surface 1231 from producing wrinkles during the bending process and makes the stop surface 1232 and the guide surface 1231 to become smooth, so as to improve the smoothness of moving the synchronization hook 13 on the stop surface 1232 and the guide surface 1231. According to the actual manufacturing tests, the round shape of the notch 1233 can prevent the stress from centralizing during the bending process or reducing the service life, so that this disclosure can effectively extend the service life.

The synchronization hook 13 is installed on a surface of the inner rail 21 relative to the middle rail 22, and protrude from a surface by bending the synchronization hook 13. The synchronization hook 13 is normally snapped and engaged with the elastic control plate 12 by the elastic part 122 to define a synchronization state. After the middle rail 22 is moved to a limit and a specified force is applied, the synchronization hook 13 props open the elastic control plate 12 to swing upwardly to define a release state, and the inner rail 21 continues to be pulled towards the outside.

In addition, the middle and inner rails synchronization mechanism 1 of this disclosure further includes a limiting plate 124 formed on a side of the elastic control plate 12 relative to the pivoting part 121. During installation, the limiting plate 124 passes through the limiting hole 113 and reaches another surface of the middle rail 22. In addition, an inner rail releasing outer rail locking hook 125 is installed to the elastic control plate 12 relative to another side of the retaining wall 123 and bent in a direction opposite to the retaining wall 123 to make the inner rail releasing outer rail locking hook 125 to pass through another surface of the middle rail 22, and the outer rail 23 includes an outer rail release part 231 installed at an outer side proximate to the pulling direction. Therefore, after the inner rail releasing outer rail locking hook 125 is triggered by the outer rail release part 231, the inner rail releasing outer rail locking hook 125 is pushed to swing, so as to release the locked state between the middle rail 22 and the inner rail 21, and sequentially pull the middle rail 22 and the inner rail 21 towards the outside.

In summation of the description above, the middle and inner rails synchronization mechanism 1 of this disclosure has the main components including the installation part 11, the elastic control plate 12 and the synchronization hook 13 which are integrally formed, the synchronization hook 13 and the elastic control plate 12 are snapped to each other to define a synchronization state for convenient operation. In addition, the guide surface 1231 and the stop surface 1232 of the elastic control plate 12 are installed at a special angle. When an improper external force hits a drawer, the synchronization hook 13 forcibly props open the elastic control plate 12 to define a release state, and thus not only can ensure a smooth operation, but also can protect the elastic plate part 122 from breaking and prevent the drawer from getting stuck and unable to be opened. This disclosure greatly simplifies the mechanical structure to reduce the assembling and manufacturing costs, and also improves the operating feel and effectively extends the service life.

What is claimed is:

1. A middle and inner rails synchronization mechanism of a slide rail, the slide rail having a three-stage telescopic structural design that comprises an inner rail, a middle rail and an outer rail, and the middle and inner rails synchronization mechanism comprising:

an installation part, integrally formed at a rear position of the middle rail;

an elastic control plate, comprising a pivoting part disposed at an end thereof, an elastic part disposed in middle of the elastic control plate and provided to be installed to the installation part such that the elastic control plate is disposed on a surface of the middle rail relative to the inner rail, a retaining wall formed by bending a side edge of the elastic control plate relative to the pivoting part, a guide surface and a stop surface integrally formed on the retaining wall corresponding to a direction when the inner rail passes through, a first set angle defined between moving tracks of the stop surface and of the middle rail, and a second set angle defined between moving tracks of the guide surface and the middle rail;

a synchronization hook, installed on a surface of the inner rail relative to the middle rail, configured to protrude from the surface by bending, and snapped with the elastic control plate to define a synchronization state, such that after the middle rail is moved to a limit and a specified force is applied, the synchronization hook props open the elastic control plate, and the inner rail continues to be pulled towards outside; and an inner rail releasing outer rail locking hook formed on a side of the elastic control plate opposite to the retaining wall, and bent in a direction opposite to a direction that the retaining wall is bent, such that the inner rail releasing outer rail locking hook passes through another surface of the middle rail, and the outer rail comprising an outer rail release part disposed at a position proximate to an outer side along pulling direction, so that after the inner rail releasing outer rail locking hook is triggered by the outer rail release part to push the inner rail releasing outer rail locking hook to swing, a locked state between the middle rail and the inner rail is released, and the middle rail and the inner rail are sequentially pulled towards outside.

2. The middle and inner rails synchronization mechanism of a slide rail according to claim 1, wherein the first set angle falls within a range of 113~115.5 degrees.

3. The middle and inner rails synchronization mechanism of a slide rail according to claim 2, wherein the second set angle falls within a range of 11~25 degrees.

4. The middle and inner rails synchronization mechanism of a slide rail according to claim 3, wherein the retaining wall is formed by bending a section of the elastic control plate, and the retaining wall is longer than the elastic control plate, and the retaining wall is bent 90 degrees relative to a plane of the elastic control plate first, and then bent to form the stop surface and the guide surface.

5. The middle and inner rails synchronization mechanism of a slide rail according to claim 4, wherein a junction of the section of the elastic control plate and the elastic control plate, particularly a notch at a bend position of the stop surface and the guide surface formed by bending and cutting makes the stop surface and the guide surface smooth and prevents the stop surface and the guide surface from producing wrinkles during bending, so as to improve smoothness of the synchronization hook when moving on the stop surface and the guide surface.

6. The middle and inner rails synchronization mechanism of a slide rail according to claim 5, wherein the notch is in a round shape for preventing a stress formed during bending from being concentrated and reducing the notch's service life.

7. The middle and inner rails synchronization mechanism of a slide rail according to claim 6, further comprising a limiting hole and a limiting plate, the limiting hole being formed on a side of the middle rail relative to the installation part, the limiting plate being formed on a side of the elastic control plate relative to the pivoting part, and during installation, the limiting plate passing through the limiting hole and reaching another surface of the middle rail.

* * * * *